US008101067B2

(12) United States Patent
Duyvesteyn et al.

(10) Patent No.: US 8,101,067 B2
(45) **Date of Patent: *Jan. 24, 2012**

(54) METHODS FOR OBTAINING BITUMEN FROM BITUMINOUS MATERIALS

(75) Inventors: Willem P. C. Duyvesteyn, Reno, NV (US); Julian Kift, Reno, NV (US)

(73) Assignee: Marathon Oil Canada Corporation, Calgary, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/575,241

(22) Filed: Oct. 7, 2009

(65) Prior Publication Data

US 2010/0032348 A1 Feb. 11, 2010

Related U.S. Application Data

(63) Continuation-in-part of application No. 12/041,554, filed on Mar. 3, 2008, now Pat. No. 7,985,333, which is a continuation-in-part of application No. 11/249,234, filed on Oct. 12, 2005, now Pat. No. 7,909,989.

(60) Provisional application No. 60/617,739, filed on Oct. 13, 2004.

(51) Int. Cl.
*C01G 1/04* (2006.01)

(52) U.S. Cl. ..... 208/390; 208/45

(58) Field of Classification Search ..... 208/45, 208/390

See application file for complete search history.

(56) References Cited

U.S. PATENT DOCUMENTS

| | | | |
|---|---|---|---|
| 2,871,180 | A | 1/1959 | Lowman |
| 3,131,141 | A | 4/1964 | West |
| 3,484,365 | A | 12/1969 | Pitchford |
| 3,527,692 | A | 9/1970 | Titus |
| 3,565,593 | A | 2/1971 | Moore et al. |
| 3,565,594 | A | 2/1971 | Moore |
| 3,779,902 | A | 12/1973 | Mitchell et al. |
| 4,035,282 | A | 7/1977 | Stuchberry et al. |
| 4,046,668 | A | 9/1977 | Farcasiu et al. |
| 4,054,506 | A | 10/1977 | Hart, Jr. et al. |
| 4,120,777 | A | 10/1978 | Globus |

(Continued)

FOREIGN PATENT DOCUMENTS

| | | |
|---|---|---|
| CA | 2224615 | 6/1999 |

(Continued)

OTHER PUBLICATIONS

International Search Report from International Application No. PCT/US2006/08263.

(Continued)

*Primary Examiner* — Walter D Griffin
*Assistant Examiner* — Renee E Robinson
(74) *Attorney, Agent, or Firm* — Holland & Hart LLP

(57) ABSTRACT

Methods for obtaining bitumen from bituminous material. The methods may include a dissolution step where a first solvent is added to material comprising bitumen to dissolve the bitumen contained therein. The majority of the dissolved bitumen is then removed from the mixture of first solvent and material comprising bitumen by filtering or settling the mixture of first solvent and material comprising bitumen. Any residual dissolved bitumen is then removed from the mixture of first solvent and material comprising bitumen by adding additional first solvent to the mixture to displace the residual dissolved bitumen from the mixture.

30 Claims, 6 Drawing Sheets

U.S. PATENT DOCUMENTS 4,139,450 A 2/1979 Hanson et al.
4,222,873 A 9/1980 Parsons
4,224,138 A 9/1980 Kruyer
4,250,016 A * 2/1981 Estes et al. ..... 208/391
4,308,133 A 12/1981 Meyer
4,347,118 A 8/1982 Funk et al.
4,490,259 A 12/1984 Coffing
4,512,872 A 4/1985 Chung et al.
4,589,980 A 5/1986 Keys
4,592,826 A 6/1986 Ganguli
4,596,651 A 6/1986 Wolff et al.
4,612,113 A 9/1986 Kallioinen
4,678,561 A 7/1987 Keys
4,678,562 A 7/1987 Keys
4,724,272 A 2/1988 Raniere et al.
4,744,890 A 5/1988 Miller et al.
4,846,964 A 7/1989 Scott et al.
4,859,317 A 8/1989 Shelfantook et al.
5,044,552 A 9/1991 Becker et al.
5,084,160 A 1/1992 Stewart et al.
5,143,598 A 9/1992 Graham et al.
5,176,802 A 1/1993 Duyvesteyn et al.
5,223,148 A 6/1993 Tipman et al.
5,236,577 A 8/1993 Tipman et al.
5,295,665 A 3/1994 Mackie
5,389,274 A 2/1995 Fernandez
5,443,158 A 8/1995 McKenny et al.
5,485,883 A 1/1996 Rippetoe et al.
5,520,799 A 5/1996 Brown et al.
5,534,136 A * 7/1996 Rosenbloom ..... 208/390
5,538,081 A 7/1996 Rippetoe et al.
5,554,301 A 9/1996 Rippetoe et al.
5,626,743 A 5/1997 Humphreys
5,626,793 A 5/1997 Reiffenrath et al.
5,670,056 A 9/1997 Yoon et al.
5,670,345 A 9/1997 Srivastava et al.
5,702,612 A 12/1997 Wang
5,728,202 A 3/1998 Nelson et al.
5,795,466 A 8/1998 Kelebek et al.
5,798,137 A 8/1998 Lord et al.
5,849,201 A 12/1998 Bradley
5,872,289 A 2/1999 Appleby et al.
5,876,592 A 3/1999 Tipman et al.
5,896,435 A 4/1999 Gautier et al.
5,961,786 A 10/1999 Freel et al.
5,968,349 A 10/1999 Duyvesteyn et al.
5,992,050 A 11/1999 Kemper et al.
6,007,709 A 12/1999 Duyvesteyn et al.
6,036,849 A 3/2000 Rippetoe et al.
6,074,558 A 6/2000 Duyvesteyn et al.
6,106,787 A 8/2000 Rippetoe
6,214,213 B1 4/2001 Tipman et al.
6,320,148 B1 11/2001 Yoon et al.
6,352,639 B2 3/2002 Ito et al.
6,427,843 B1 8/2002 Clark
6,514,310 B2 2/2003 Allemand et al.
6,589,417 B2 7/2003 Taciuk et al.
6,595,163 B2 7/2003 Dumaz et al.
6,764,542 B1 7/2004 Lackey et al.
6,768,015 B1 7/2004 Luxem et al.
6,793,079 B2 9/2004 Khan et al.
6,822,105 B1 11/2004 Luxem et al.
6,827,786 B2 12/2004 Lord
6,827,841 B2 12/2004 Kiser et al.
6,871,743 B2 3/2005 Yoon et al.
6,936,227 B1 8/2005 De Souze et al.
6,965,044 B1 11/2005 Hammond et al.
6,989,091 B2 1/2006 Jorgensen
7,011,749 B2 3/2006 Hayes et al.
7,018,435 B1 3/2006 Wentinck
7,097,675 B2 8/2006 Detering et al.
7,464,756 B2 12/2008 Gates et al.
7,585,407 B2 9/2009 Duyvesteyn
7,588,682 B2 9/2009 Norman
7,811,444 B2 10/2010 Duyvesteyn et al.
7,824,453 B2 11/2010 Duyvesteyn
7,909,989 B2 3/2011 Duyvesteyn et al.
7,985,333 B2 7/2011 Duyvesteyn
2002/0134704 A1 9/2002 Mitchell et al.
2005/0070218 A1 3/2005 Phillips et al.
2005/0092682 A1 5/2005 Phillips et al.
2006/0076274 A1 4/2006 Duyvesteyn et al.
2006/0144760 A1 7/2006 Duyvesteyn et al.
2007/0170095 A1 7/2007 Freel et al.
2007/0209971 A1 9/2007 Duyvesteyn et al.
2007/0284283 A1 12/2007 Duyvesteyn et al.
2008/0060257 A1 3/2008 Duyvesteyn
2008/0156702 A1 7/2008 Duyvesteyn
2008/0242875 A1 10/2008 Hong et al.
2009/0090654 A1 4/2009 Duyvesteyn et al.
2009/0145809 A1 6/2009 Ledbetter, Jr. et al.
2009/0294332 A1 12/2009 Ryu
2009/0301937 A1 12/2009 Duyvesteyn et al.
2011/0017642 A1 1/2011 Duyvesteyn
2011/0062057 A1 3/2011 Duyvesteyn
2011/0155648 A1 6/2011 Duyvesteyn et al.

FOREIGN PATENT DOCUMENTS

WO WO 01/32936 5/2001
WO WO 03/072506 9/2003
WO WO 2007/102819 9/2007
WO WO 2011/082209 7/2011

OTHER PUBLICATIONS

International Search Report from International Application No. PCT/US2005/36728.

Hong, P.K. Andrew, et al., "A Polar-Nonpolar, Acetic Acid/Heptane, Solvent Medium for Degradation of Pyrene by Ozone", Ind. Eng. Chem. Res. 2004, vol. 43, pp. 7710-7715.

International Search Report, PCT/US2010/62133, Aug. 30, 2011 (3 pp.).

U.S. Appl. No. 13/273,975, filed Oct. 14, 2011, Process for Extracting Bitumen and Drying the Tailings.

U.S. Appl. No. 12/964,612, filed Dec. 9, 2010, Process for Extracting Bitumen and Drying the Tailings.

U.S. Appl. No. 12/956,701, filed Nov. 30, 2010, Methods for Extracting Bitumen from Bituminous Materials.

U.S. Appl. No. 12/692,127, filed Jan. 22, 2010, Methods fro Extracting Bitumen from Bituminous Material.

Biodiesel Processing, Mar. 22, 2004 (3 pp.).

Biodiesel Processing, biodiesel Handout for 2005 New Hampshire Science Tearher's Association Workshop UNH Biodiesel Group, http://www.unh.edu/p2/biodiesel, 2005 (27 pp.).

Campbell, National Biodiesel Board 2005 Annual Meeting, Marina Marriott, Ft. Lauderdale, FL, Feb. 1, 2005 (9 pp.).

Cohen et al., "Degradation of Coal by Fungi *Polyporus versicolor* and *Poria monticola*," Appl. Enviorn. Microbiol., 44(1):23-27, Jul. 1982 (5 pp.).

Desolventizer-Toaster, Crown Iron Works Company, PDF file created Feb. 16, 2010, (3 pp.).

Gallmetzer et al., "Efflux of Organic Acids in *Penicillium simplicissimum* is an Energy-Spilling Porcess . . . ," Microbiology 148:1143-1149, 2002 (7 pp.).

Houdaille, "Jet Pump Techinical Data—Puming Liquids," pp. 1-11, 1982 (12 pp.).

International Search Report, PCT/US10/43822, Nov. 29, 2010 (4 pp.).

International Search Report, PCT/US10/43082, Sep. 14, 2010 (11 pp.).

International Search Report and Written Opinion, PCT/US09/35552, Apr. 17, 2009 (8 pp.).

International Search Report and Written Opinion, PCT/US07/19222, Apr. 28, 2008 (8 pp.).

International Search Report, PCT/US2005/34092, Jul. 26, 2007 (6 pp.).

Lewis, "Liquefied Petroleum Gas," Hawley's condensed Chemical Dictionary (14th Edition), John Wiley Sons. , 2002 (1 p.).

Rogoff et al., "The Microbiology of Coal," Bureau of Mines, U.S. Dept. of the Interior, Region V, Bruceton, PA, 73:264-268, Aug. 23, 1956 (5 pp.).
Soygold, Environmental Solutions to Your Market Challenges, http://www.soygold.com/applications.htm, printed Mar. 6, 2007 (2 pp.).
Vicente et al., "A Comparative Study of Vegetable Oils for Biodiesel Production in Spain," Energy & Fuels, 20:394-398, 2006 (published on Web Nov. 8, 2005) (5 pp.).

* cited by examiner

METHODS FOR OBTAINING BITUMEN FROM BITUMINOUS MATERIALS

CROSS-REFERENCE TO RELATED PATENT APPLICATIONS

This patent application is a continuation-in-part of U.S. patent application Ser. No. 12/041,554, now U.S. Pat. No. 7,985,333 entitled "System and Method of Separating Bitumen from Tar Sand," filed Mar. 3, 2008, published as U.S. Patent Application Publication No. 2008/0210602, which is a continuation-in-part of U.S. patent application Ser. No. 11/249,234, now U.S. Pat. No. 7,909,989 entitled "Method for Obtaining Bitumen from Tar Sands," filed on Oct. 12, 2005, published as U.S. Patent Application Publication No. 2006/0076274, which claims priority to U.S. Provisional Patent Application Ser. No. 60/617,739, filed on Oct. 13, 2004, all of which are incorporated herein by reference in their entireties. In the event of a conflict, the subject matter explicitly recited or shown herein controls over any subject matter incorporated by reference. All definitions of a term (express or implied) contained in any of the subject matter incorporated by reference herein are hereby disclaimed.

BACKGROUND

Bitumen is a heavy type of crude oil that is often found in naturally occurring geological materials such as tar sands, black shales, coal formations, and weathered hydrocarbon formations contained in sandstones and carbonates. Some bitumen can be described as flammable brown or black mixtures or tarlike hydrocarbons derived naturally or by distillation from petroleum. Some bitumen can be in the form of a viscous oil to a brittle solid, including asphalt, tars, and natural mineral waxes. Substances containing bitumen are typically referred to as bituminous, e.g., bituminous coal, bituminous tar, or bituminous pitch. At room temperature, the flowability of some bitumen is much like cold molasses. Bitumen can be processed to yield oil and other commercially useful products, primarily by cracking the bitumen into lighter hydrocarbon material.

As noted above, tar sands represent one of the well known sources of bitumen. Tar sands typically include bitumen, water and mineral solids. The mineral solids can include inorganic solids such as coal, sand, and clay. Tar sand deposits can be found in many parts of the world, including North America. One of the largest tar sands deposits is in the Athabasca region of Alberta, Canada. In the Athabasca region, the tar sands formation can be found at the surface, although it can also be buried two thousand feet below the surface overburden or more. Tar sands deposits are measured in barrels equivalent of oil. It is estimated that the Athabasca tar sands deposit contains the equivalent of about 1.7 to 2.3 trillion barrels of oil. Global tar sands deposits have been estimated to contain up to 4 trillion barrels of oil. By way of comparison, the proven worldwide oil reserves are estimated to be about 1.3 trillion barrels.

The bitumen content of some tar sands varies from approximately 3 wt % to 21 wt %, with a typical content of approximately 12 wt %. Accordingly, an initial step in deriving oil and other commercially useful products from bitumen typically requires extracting bitumen from the naturally occurring geological material. In the case of tar sands, this can include separating the bitumen from the mineral solids and other components of tar sands.

One conventional process for separating bitumen from mineral solids and other components of tar sands includes mixing the tar sands with hot water and, optionally, a process aid such as caustic soda (see, e.g., U.S. Pat. No. 1,791,797). Agitation of this mixture releases bitumen particles from the tar sands and allows air bubbles to attach to the released bitumen particles. These air bubbles float to the top of the mixture and form a bitumen-enriched froth. In Applicant's experience, such a froth typically includes around 60% bitumen, 30% water, and 10% inorganic minerals. The bitumen-enriched froth is separated from the mixture, sometimes with the aid of a solvent, and further processed to isolate the bitumen product. For example, the froth can be treated with an aliphatic (pentane-type) or an aromatic (naphtha-type) solvent to produce a clean bitumen product that can serve as a refinery upgrader feed stock. The bulk of the mineral solids can also be removed to form a tailings stream. Typically, the tailings stream also includes water, solvent, precipitated asphaltenes (in the case where the asphaltene is not soluble in the solvent used to separate the bitumen-enriched froth from the mixture), and some residual bitumen.

One issue with conventional hot water extraction methods is that they may achieve relatively low bitumen recoveries when used on low grade bituminous materials (e.g., bituminous material having a bitumen content of 10 wt % or less). Low recovery rates will be especially problematic in regions where a regulatory board stipulates a minimum bitumen recovery for certain grades of bituminous material. For example, the Alberta Energy and Utilities Board has implemented guidelines requiring that the bitumen recovery rate for hot water extraction using naphtha-based froth treatment of ore sands having less than 11% bitumen content satisfy the following equation:

$$\text{Bitumen Recovery} \geqq -2.5*(\text{Ore Grade})^2+54.1*(\text{Ore Grade})-202.6 \quad (1)$$

where both Bitumen Recovery and Ore Grade are expressed in wt-%. FIG. 1 provides a graphical representation of Equation (1) set against data for actual bitumen recoveries achieved on ore sands of various grades when using a hot water extraction process using paraffinic froth treatment. In FIG. 1, the line marked A represents the minimum required bitumen recovery rate for various ore grades as defined by the Alberta Energy and Utilities Board according to Equation (1) above, while line B represents a least square fit of a set of extraction data from a hot water extraction operating plant in the Athabasca region. As can be seen in FIG. 1, the actual bitumen recoveries achieved from this set of data in the range between approximately 10% and 11% fall below the board's directive for bitumen extraction. Furthermore, an extrapolation of line B back towards the lower ore grades would suggest that the actual bitumen recoveries from the hot water extraction method continue to fall below the mandated minimum. Accordingly, it is possible that these hot water extraction methods will not be permitted for extracting bitumen from lower grade bituminous material.

The difficulty for conventional hot water extraction methods in extracting bitumen from low grade bituminous materials typically stems from the impact that hot water has on the relatively high content of certain clay components in low grade tar sands ores. In Applicant's experience, the introduction of caustic hot water during the extraction process typically causes certain clay components (e.g., montmorillonite) in the bituminous material to activate and swell, especially when the caustic hot water contains divalent ions such as calcium. The swollen and activated clay will then mix with the water phase introduced to the bituminous material by the hot water extraction methods and produce a clay suspension with a relatively high viscosity and density. If the clay suspension is present rather than just hot water, surfactants produced during the natural weathering of the asphaltene components of the bitumen phase that normally liberate bitumen by reducing interfacial tensions between bitumen particles and sand particles will instead absorb on the clay particles. A reduction in the number of liberated bitumen particles will likely impact the efficient production of a high grade bitumen froth, as there are fewer liberated bitumen particles to attach to air bubbles during the flotation step. Furthermore, it is typically more difficult for proper air bubbles to be formed in a clay suspension.

As a result of the inability of conventional hot water extraction methods to recover acceptable amounts of bitumen from low grade bituminous materials, the versatility of the conventional methods is curtailed. The conventional methods are limited to processing higher grade bituminous materials, which ultimately makes the conventional methods more expensive to carry out. Additionally, without a method for economically processing low grade bituminous material, a significant portion of the world's bitumen resources can end up going to waste.

SUMMARY

Disclosed are embodiments of a method for obtaining bitumen from bituminous materials. In some embodiments, a method for obtaining bitumen from bituminous materials may include mixing a first material comprising bitumen with a first solvent to form a first mixture. The first mixture may include a bitumen-enriched solvent phase. The method may also include separating a first quantity of the bitumen-enriched solvent phase from the first mixture. Separation of the first quantity of the bitumen-enriched solvent phase from the first mixture may be accomplished by filtering or settling the first mixture. The method may also include separating a second quantity of the bitumen-enriched solvent phase from the first mixture. Separation of the first quantity of the bitumen-enriched solvent phase may be accomplished by adding a second solvent to the first mixture in order to displace the second quantity of bitumen-enriched solvent phase from the first mixture.

In some embodiments, a method for obtaining bitumen from bituminous material may include mixing a material comprising bitumen with a first solvent. The method may also include filtering or separating a first portion of the bitumen-enriched solvent phase from the first result of mixing the material comprising bitumen with the first quantity of first solvent. The method may also include adding a second solvent to a second result of filtering or separating the first portion of the bitumen-enriched solvent phase from the first result.

It is to be understood that the foregoing is a brief summary of various aspects of some disclosed embodiments. The scope of the disclosure need not therefore include all such aspects or address or solve all issues noted in the background above. In addition, there are other aspects of the disclosed embodiments that will become apparent as the specification proceeds.

The foregoing and other features, utilities, and advantages of the subject matter described herein will be apparent from the following more particular description of certain embodiments as illustrated in the accompanying drawings. In this regard, it is to be understood that the scope of the invention is to be determined by the claims as issued and not by whether given subject includes any or all features or aspects noted in this Summary or addresses any issues noted in the Background.

BRIEF DESCRIPTION OF THE DRAWINGS

The preferred and other embodiments are disclosed in association with the accompanying drawings in which.

DETAILED DESCRIPTION

Before describing the details of the various embodiments herein, it should be appreciated that the terms "solvent," "a solvent" and "the solvent" include one or more than one individual solvent compound unless expressly indicated otherwise. Mixing solvents that include more than one individual solvent compound with other materials can include mixing the individual solvent compounds simultaneously or serially unless indicated otherwise. It should also be appreciated that the term "tar sands" includes oil sands. The separations described herein can be partial, substantial or complete separations unless indicated otherwise. All percentages recited herein are weight percentages unless indicated otherwise.

Tar sands are used throughout this disclosure as a representative material comprising bitumen. However, the methods disclosed herein are not limited to processing of tar sands. Any material comprising bitumen may be processed by the methods disclosed herein.

Figure 2:
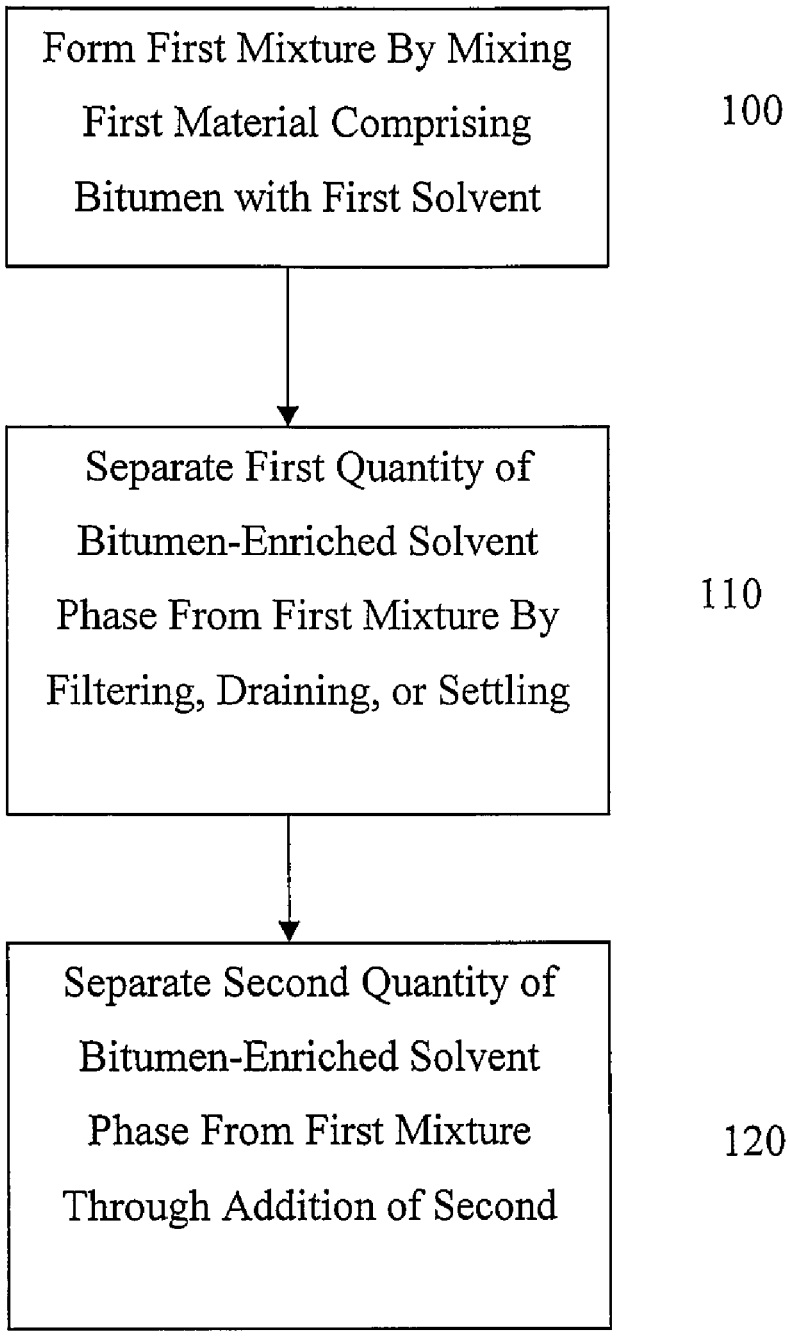
FIG. 2 is a flow chart detailing a method for obtaining bitumen from bituminous material as disclosed herein.

With reference to FIG. 2, a first embodiment of a method for obtaining bitumen from bituminous materials may include a step 100 of mixing a material comprising bitumen with a first solvent to form a first mixture, a step 110 of separating a first quantity of bitumen-enriched solvent phase from the first mixture, and a step 120 of separating a second quantity of bitumen-enriched solvent phase from the first mixture.

The step 100 of mixing a material comprising bitumen with a first solvent to form a first mixture represents a solvent extraction step (also sometimes referred to as dissolution, solvation, or leaching). Solvent extraction is a process of separating a substance from a material by dissolving the substance of the material in a liquid. In this situation, the material comprising bitumen is mixed with one or more solvents to dissolve bitumen in the solvent and thereby separate it from the other components of the material comprising bitumen (e.g., the mineral solids of tar sands).

The first solvent used in the mixing step may include a hydrocarbon solvent. Any suitable hydrocarbon solvent or mixture of hydrocarbon solvents that is capable of dissolving bitumen may be used. In some embodiments, the hydrocarbon solvent may be a hydrocarbon solvent that does not result in asphaltene precipitation. The hydrocarbon solvent or mixture of hydrocarbon solvents can be economical and relatively easy to handle and store. The hydrocarbon solvent or mixture of hydrocarbon solvents may also be generally compatible with refinery operations.

In some embodiments, the first solvent may be a light aromatic solvent. The light aromatic solvent may be an aromatic compound having a boiling point temperature less than about 400° C. at atmospheric pressure. In some embodiments, the light aromatic solvent used in the first mixing step may be an aromatic having a boiling point temperature in the range of from about 75° C. to about 350° C. at atmospheric pressure, and more specifically, in the range of from about 100° C. to about 250° C. at atmospheric pressure. In some embodiments, the light aromatic solvent may be an aromatic having a boiling point temperature less than 200° C.

It should be appreciated that the light aromatic solvent need not be 100% aromatic compounds. Instead, the light aromatic solvent may include a mixture of aromatic and non-aromatic compounds. For example, the first solvent can include greater than zero to about 100 wt % aromatic compounds, such as approximately 10 wt % to 100 wt % aromatic compounds, or approximately 20 wt % to 100 wt % aromatic compounds.

Any of a number of suitable aromatic compounds may be used as the first solvent. Examples of aromatic compounds that can be used as the first solvent include benzene, toluene, xylene, aromatic alcohols and combinations and derivatives thereof. The first solvent can also include compositions, such as kerosene, diesel (including biodiesel), light gas oil, light distillate (distillate having boiling point temperature in the range of from 140° C. to 260° C.), commercial aromatic solvents such as Solvesso 100, Solvesso 150, and Solvesso 200 (also known in the U.S.A. as Aromatic 100, 150, and 200, including mainly $C_{10}$-$C_{11}$ aromatics, and produced by ExxonMobil), and/or naphtha. In some embodiments, the first solvent may have a boiling point temperature of approximately 75° C. to 375° C. Naphtha, for example, may be particularly effective at dissolving bitumen and may be generally compatible with refinery operations.

The material comprising bitumen used in the mixing step may be any material that includes bitumen. Exemplary materials comprising bitumen include, but are not limited to, tar sands, black shales, coal formations, and hydrocarbon sources contained in sandstones and carbonates. The material comprising bitumen may be obtained by any known methods for obtaining material comprising bitumen, such as by surface mining, underground mining, or any other in situ extraction methods, such as vapor extraction (Vapex), and steam assisted gravity drainage (SAGD) extraction.

In some embodiments, the material comprising bitumen may be low grade material comprising bitumen. Low grade material comprising bitumen may include any material having a bitumen content of less than about 10 wt %.

The aim of mixing the first solvent and the material comprising bitumen at 100 may be to have the first solvent fully penetrate the material comprising bitumen so that the entire bitumen content of the material comprising bitumen may be dissolved by the first solvent. Accordingly, any mixing process or mixing device known to those of ordinary skill in the art that will allow for the first solvent to disperse throughout the bituminous material and solvate the bitumen content of the bituminous material may be used.

The amount of time during which the first solvent and material comprising bitumen are mixed may be one factor that affects how comprehensively the first solvent dissolves the bitumen content of the material comprising bitumen. Generally speaking, the material may be mixed for any period of time. In some embodiments, mixing may be carried out for from 5 seconds to 60 minutes. With tar sand clumps of 3 inches or less, the mixing time may be limited to less than 30 minutes in order to avoid emulsion formation as discussed in greater detail below.

The manner in which the first solvent and material comprising bitumen are mixed may be another factor that affects how comprehensively the first solvent dissolves the bitumen content of the material comprising bitumen. Generally speaking, any mixing method may be used. In some embodiments, the mixing methods include the use of mixing devices, such as rotating blades or propellers. For example, the first solvent and the material comprising bitumen may be contained in a vessel having a mixing blade or propeller included therein. Engaging the mixing blade or propeller may mix the two materials together and help ensure that the first solvent fully penetrates the material comprising bitumen to dissolve the bitumen. In some embodiments, mixing may also be accomplished through the use of a rotating vessel in which the first solvent and material comprising bitumen may be contained. For example, the material comprising bitumen and the first solvent may be mixed by using a rotary drum plus trammel screen. The material comprising bitumen and first solvent may be added to the rotary drum at the same time to thereby produce a first mixture with barren over size material removed from the first mixture.

In some embodiments, the vessel used for mixing the first solvent and the material comprising bitumen need not have moving parts, such as a mixing blade or a rotating drum. Rather, mixing between the first solvent and the material comprising bitumen may be accomplished by the manner in which the materials are introduced into a vessel. For example, first solvent may be introduced into a vessel already containing material comprising bitumen at a relatively high velocity, thereby effectively causing agitation and mixing between the first solvent and the material comprising bitumen. In some embodiments, the first solvent need not be introduced at a relatively high velocity. Rather, the first solvent may be poured over material comprising bitumen packed in a vessel or in a heap on a pad and allowed to flow downwardly through the material comprising bitumen under the force of gravity or an externally applied force (such as overpressure or vacuum pressure). In this manner, the first solvent may fully penetrate the material comprising bitumen and achieve comprehensive dissolution of the bitumen without the need for agitation of the first solvent and material comprising bitumen.

The power used to mix the first solvent and the material comprising bitumen may also be controlled to ensure adequate bitumen dissolution while avoiding certain undesirable side effects. In some embodiments, the power used when mixing at 100 may be controlled in order to avoid the formation of water-solvent emulsions. Material comprising bitumen may include from about 2 wt % to about 10 wt % water, and excessive mixing with the first solvent can result in the formation of certain water-solvent emulsions that can be quite stable. However, by controlling the amount of power used when mixing (along with other factors such as the mixing time), the water content of the material comprising bitumen may stay associated with the non-bitumen components of the material comprising bitumen. Generally, any mixing regime that produces a Reynolds number in excess of 10,000 would likely result in the formation of certain water-solvent emulsions. Accordingly, in some embodiments, any mixing power that produces a first mixture having a Reynolds number less than 10,000 may be used. Such a result may be achieved by utilizing low intensity blending over an extended period of time, rather than blending at high intensities for shorter periods of time.

Additionally, using a mixing regime that results in a first mixture having a Reynolds number less than 10,000 may also avoid the undesirable breakdown or disintegration of any clay components of the material comprising bitumen. In some embodiments, the breakdown of clay components may be avoided by utilizing a mixing regime that produces a first mixture having a Reynolds number of less than 2,000 and with only laminar flow characteristics.

Mixing first solvent and material comprising bitumen at 100 may be performed at any suitable temperature and pressure. In certain embodiments, it may be desirable to perform the mixing at a reduced pressure to maintain the first solvent as a liquid during the mixing. In some embodiments, mixing may be performed at higher temperatures to allow for the use of a wider range of suitable first solvents (e.g., aromatic solvents having a boiling point temperature higher than 400° C.). The higher mixing temperature may be achieved by using first solvent recovered from the method described herein. Such first solvent may be recovered using a distillation process and therefore may have a high temperature (e.g., just below its boiling point temperature). Accordingly, when this first solvent is mixed with room temperature bituminous material, the mixing occurs at elevated temperature.

The step 100 of mixing a material comprising bitumen and a first solvent according to any of the above procedures and parameters can be performed as a continuous, batch, or semi-batch process. Continuous processing may typically be used in larger scale implementations. However, batch processing may result in more complete separations than continuous processing.

The amount of the first solvent added to the material comprising bitumen may be a sufficient amount to effectively dissolve at least a portion, or desirably all, of the bitumen in the material comprising bitumen. In some embodiments, the amount of the first solvent mixed with the material comprising bitumen may be approximately 0.5 to 6.0 times the amount of bitumen by volume contained in the material comprising bitumen, approximately 0.6 to 3.0 times the amount of bitumen by volume contained in the material comprising bitumen, or approximately 0.75 to 2.0 times the amount of bitumen by volume contained in the material comprising bitumen. The amount of first solvent mixed with the material comprising bitumen may be sufficient to fill up the open spaces between particles in the material comprising bitumen. In some embodiments, a minimum amount of solvent necessary to solvate most or all of the bitumen content of the material comprising bitumen may be added. In this manner, first solvent may be conserved and subsequent separation steps may be simplified (or eliminated altogether).

The mixing of the first solvent and the material comprising bitumen may generally result in the formation of a first mixture comprising a bitumen-enriched solvent phase. The bitumen-enriched solvent phase may include bitumen dissolved in the first solvent. In some embodiments, 80%, preferably 90%, and most preferably 95% or more of the bitumen in the material comprising bitumen may be dissolved in the first solvent and becomes part of the bitumen-enriched solvent phase.

In step 110, a first quantity of bitumen-enriched solvent phase may be separated from the first mixture. Any suitable method for separating the first quantity of bitumen-enriched solvent phase from the first mixture may be used. In some embodiments, the bitumen-enriched solvent phase may be separated from the first mixture by filtering or settling the first mixture.

Filtering of the first mixture may generally include any process wherein a filter medium is used to maintain the non-bitumen components of the material comprising bitumen on one side of the filter medium while allowing the bitumen-enriched solvent phase to collect on the opposite side of the filter medium by passing through the filter medium. Any type of filter medium may be used provided the filter medium is capable of preventing the flow of at least a portion of the non-bitumen components through the filter medium while allowing bitumen-enriched solvent phase to flow through the filter medium.

In some embodiments, the filtering process may involve a vacuum filter. The vacuum filter may be static (e.g., a pan filter) or continuous (e.g., a belt filter). The bitumen-enriched solvent phase may flow down through and out of the filter while the non-bitumen components of the material comprising bitumen remain in the filter.

In some embodiments, the filtering process may involve the use of a plate and frame-type filter press. The first mixture may be loaded in a frame chamber lined on either side with filter clothes. As the first mixture fills the frame chamber, the bitumen-enriched solvent phase may pass through the filter clothes and out of the frame chamber, leaving the non-bitumen components of the material comprising bitumen behind. Any plate and frame-type filter press known to those of ordinary skill in the art may be used. An exemplary plate and frame-type filter press suitable for use in this method is described in U.S. Pat. No. 4,222,873.

Any of the filtration methods suitable for use in separating a first quantity of bitumen-enriched solvent phase from the first mixture may include the injection of gas over the first mixture to further promote separation. For example, in the case of filtering the first mixture via a plate and frame-type filter press, gas may be injected into the frame chamber after the frame chamber has been filled with the first mixture to further promote the separation of the bitumen-enriched solvent phase from non-bitumen components in the first mixture. Bitumen-enriched solvent phase liberated by the introduction of gas may then pass out of the filter chamber as part of the first quantity of bitumen-enriched solvent phase. Alternatively, the liberated bitumen-enriched solvent phase may remain in the first mixture, but will be repositioned so as to increase the likelihood that the liberated bitumen-enriched solvent phase is displaced from the first mixture during the separation of the second quantity of the bitumen-enriched solvent phase by the addition of a second quantity of first solvent to the first mixture. Any suitable gas may be used for promoting separation during filtration. In some embodiments, the gas may be any inert gas. In some embodiments, the gas may be nitrogen, carbon dioxide or steam. The amount of gas used with filtration is not limited. In the case of a plate and frame-type filter press, 1.8 $m^3$ to 10.6 $m^3$ of gas per ton of material comprising bitumen may be injected into the frame chamber. This is equivalent to a range of about 4.5 liters to 27 liters of gas per liter of material comprising bitumen. In some embodiments, 3.5 $m^3$ of gas per ton of material comprising bitumen may be used.

Settling of the first mixture may generally include any process wherein the heavier components of the first mixture are allowed to settle to the bottom of the first mixture under the influence of gravity or externally applied forces or a combination thereof, while the lighter components of the first mixture reside at the top of the first mixture and above of the heavier components of the mixture.

In some embodiments, settling of the first mixture may result in the non-bituminous components of the material comprising bitumen (e.g., mineral solids of tar sands) settling to the bottom of the first mixture while the bitumen-enriched solvent phase remains at the top of the first mixture and above the non-bituminous components of the material comprising bitumen. A first quantity of bitumen-enriched solvent phase may then be separated from the first mixture by any of a variety of procedures. In some embodiments, less than 100% of the bitumen-enriched solvent phase may be separated from the settled first mixture as a first quantity of bitumen-enriched solvent. Therefore, a second quantity of bitumen-enriched solvent phase may be removed from the settled first mixture via a second separation step described in greater detail below.

Settling may be carried out according to any known settling technique suitable for use with mixtures of solvents and materials comprising bitumen. In some embodiments, the settling technique includes storing the first mixture in a vessel for a period of time, during which gravity acts on the first mixture to cause the heavier components of the first mixture to settle to the bottom of the vessel. In some embodiments, pressure may be applied over the first mixture or a vacuum may be applied under the first mixture to promote the settling of the heavier components.

Settling may also be carried out for any suitable period of time. Generally speaking, settling carried out for longer periods of time will result in greater separation between the non-bituminous components of the material comprising bitumen and the bitumen-enriched solvent phase.

Any method of separating a first quantity of bitumen-enriched solvent phase from the settled first mixture may be used. In some embodiments, a first quantity of bitumen-enriched solvent phase is decanted from the top of the settled first mixture. Decanting may generally include pouring the top portion of the settled first mixture (i.e., bitumen-enriched solvent phase) out of a vessel in which the first mixture was settled while retaining the bottom portion of the settled mixture (i.e., the non-bituminous components of the material comprising bitumen) in the settling vessel. Separation of a first quantity of bitumen-enriched solvent phase from a settled first mixture may also include skimming the first quantity of bitumen-enriched solvent phase from the top of the settled first mixture.

Settling of the first mixture may also result in the creation of a filter aid that may be used to further separate the bitumen-enriched solvent phase from the non-bituminous components of the first mixture. During settling, the heavier components may settle to the bottom of the first mixture and form a porous layer that may serves as a filter aid. That is to say, liquids may pass through the porous layer/filter aid and any solid particulate contained in the liquid may be filtered out of the liquid as it passes through the porous layer/filter aid. Therefore, to the extent that any non-bituminous material is still contained in the bitumen-enriched solvent phase after settling, such non-bituminous material may be filtered out of the bitumen-enriched solvent phase by filtering the bitumen-enriched solvent phase through the porous layer/filter aid formed during settling. Additionally, after the bitumen-enriched solvent phase has been separated from the porous layer/filter aid, further wash fluid (e.g., additional first solvent) may be passed through the porous layer to remove any residual amounts of bitumen that may not have been dissolved during the mixing step 100.

Any of the above described separation methods can be performed as continuous, batch, or semi-batch processes. Continuous processing may typically be used in larger scale implementations. However, batch processing may result in more complete separations than continuous processing.

The amount of bitumen-enriched solvent phase separated from the first mixture to make up the first quantity of bitumen-enriched solvent phase is not limited. In some embodiments, the first quantity of bitumen-enriched solvent phase may be equal to from about 5% to about 75% of the total amount of bitumen-enriched solvent phase included in the first mixture.

As noted above, the composition of the bitumen-enriched solvent phase may generally include bitumen and first solvent. In some embodiments, the first quantity of bitumen-enriched solvent phase removed from the first mixture may include from about 5 wt % to about 25 wt % of bitumen and from about 75 wt % to about 95 wt % of the first solvent. The bitumen-enriched enriched solvent phase may include little or no non-bitumen components of the material comprising bitumen (e.g., mineral solids).

In step 120, a second quantity of bitumen-enriched solvent phase may be separated from the first mixture. The addition of a second solvent to the first mixture may displace the second quantity bitumen-enriched solvent phase that is still present in the first mixture after the separation step 110 and thereby force the second quantity of bitumen-enriched solvent phase out of the first mixture. Some of the second solvent may remain in the first mixture, but little to no bitumen-enriched solvent phase may remain.

The second solvent may be the same class of first solvent (i.e., a light aromatic hydrocarbon) or the exact same first solvent as used when mixing first solvent with the material comprising bitumen. Alternatively, the second solvent may be a different solvent from the first solvent (i.e., a non-light aromatic solvent).

In some embodiments where a second solvent used is different from the first solvent, the second solvent may be a polar solvent. The polar solvent can be any suitable polar solvent that is capable of displacing the first solvent. In some embodiments, the polar solvent may be an oxygenated hydrocarbon. Oxygenated hydrocarbons may include any hydrocarbons having an oxygenated functional group. Oxygenated hydrocarbons may include alcohols, ketones and ethers. Oxygenated hydrocarbons as used in the present application do not include alcohol ethers or glycol ethers.

Suitable alcohols for use as the polar solvent may include methanol, ethanol, propanol, and butanol. The alcohol may be a primary (e.g., ethanol), secondary (e.g., isopropyl alcohol) or tertiary alcohol (e.g., tert-butyl alcohol).

As noted above, the polar solvent may also be a ketone. Generally, ketones are a type of compound that contains a carbonyl group (C═O) bonded to two other carbon atoms in the form: R1(CO)R2. Neither of the substituents R1 and R2 may be equal to hydrogen (H) (which would make the compound an aldehyde). A carbonyl carbon bonded to two carbon atoms distinguishes ketones from carboxylic acids, aldehydes, esters, amides, and other oxygen-containing compounds. The double-bond of the carbonyl group distinguishes ketones from alcohols and ethers. The simplest ketone is acetone, CH3-CO—CH3 (systematically named propanone).

In some embodiments where the second solvent used is different from the first solvent, the second solvent can include one or more volatile hydrocarbon solvents. Volatile hydrocarbon solvents may generally include hydrocarbons having a boiling point temperature between about −20° C. and 150° C. Volatile hydrocarbon solvents may also include aliphatic compounds that are capable of solvating bitumen and/or the first solvent. Suitable aliphatic compounds can include compounds such as alkanes or alkenes. Any of these aliphatic compounds can be functionalized or non-functionalized. In some embodiments, the second solvent may include one or more aliphatic hydrocarbons having 3 to 9 carbon atoms. In some embodiments, the second solvent may include aliphatic hydrocarbons having no more than 9 carbon atoms. The second solvent may also include lower carbon paraffins, such as cyclo- and iso-paraffins having 3 to 9 carbon atoms. The second solvent may include one or more of any of the following compounds: methane, ethane, propane, butane, and/or pentane, alkene equivalents of these compounds and/or combinations and derivatives thereof.

In some embodiments, the second solvent may include liquefied petroleum gas (LPG). The term "liquefied petroleum gas" is used broadly herein to refer to any hydrocarbon gas (hydrocarbons that are gases at ambient temperature (25° C.) and pressure (1 atm)) that has been compressed to form a liquid. Preferably, the LPG may be primarily or even entirely propane or predominantly or entirely butane. However, other LPG formulations are contemplated including commercially available formulations. The composition of common commercial LPG can vary depending on the time of the year, geographical location, etc. Commercial LPG is a natural derivative of both natural gas and crude oil. Often, LPG is a mixture of propane and butane (n-butane and/or i-butane) with small amounts of propylene and butylene (any one or combination of the four isomers). A powerful odorant such as ethanethiol is typically added to make it easy to detect leaks. Commercial LPG also often contains very small amounts of lighter hydrocarbons, such as ethane and ethylene, and heavier hydrocarbons such as pentane.

Three examples of commercial LPG are shown below in Error! Reference source not found.1:

TABLE 1

Examples of Commercially Available LPG

| Component | HD-5 Propane | Commercial Propane | Commercial Butane/Propane Mixture |
|---|---|---|---|
| Lighter Hydrocarbons | Min 90% (liq vol.) propane Max 5% (liq. vol.) propylene | Mixture of propane and/or propylene | Mixture of Butane and/or butylenes and propane and/or propylenes |
| Butane and heavier hydrocarbons | 2.5% (liq. vol.) | 2.5% (liq. vol.) | — |
| Pentane and heavier hydrocarbons | — | — | Max 2% (liq. vol.) |
| Residual matter | 0.05 ml | 0.05 ml | — |
| Total Sulfur | 123 PPMW | 185 PPMW | 140 PPMW |

LPG may be stored and transported under pressure to maintain the hydrocarbons as liquids. In some embodiments, LPG may have a boiling point at atmospheric pressure of approximately −80° C. to 10° C., desirably, approximately −55° C. to 5° C., or, suitably, approximately −35° C. to −5° C.

Any suitable amount of second solvent may be added to the first mixture in order to displace the second quantity of bitumen-enriched solvent phase. In some embodiments, the second solvent may be added to the first mixture in an amount of from about 10% to about 400% of the amount of first solvent mixed with the material comprising bitumen during step 100.

The second quantity of bitumen-enriched solvent phase displaced from the first mixture may include predominantly bitumen and first solvent. In some embodiments, the second quantity of bitumen-enriched solvent phase may include from about 5 wt % to about 50 wt % bitumen and from about 50 wt % to about 95 wt % first solvent. Little to no non-bitumen components of the material comprising bitumen may be present in the second quantity of bitumen-enriched solvent phase.

After removal of the second quantity of bitumen-enriched solvent phase, the first mixture may include little or no bitumen. In some embodiments, the first mixture may include from 0 wt % to about 2 wt % bitumen, from about 2 wt % to about 15 wt % first solvent, and from about 83 wt % to about 98 wt % non-bitumen components after separation of the second quantity of bitumen-enriched solvent phase.

Any suitable method for adding a second solvent to the first mixture may be used to separate the second quantity bitumen-enriched solvent phase from the first mixture. In some embodiments, the second solvent may be added to the first mixture as part of a countercurrent washing process. In some embodiments, the second solvent may be added to a first mixture loaded in a plate and frame-type filter press. In some embodiments, the second solvent may be added to a first mixture loaded in a vertical column.

When a countercurrent process is used to add the second solvent, the process may generally include moving the first mixture in one direction while passing the second solvent through the first solvent-wet tailings in an opposite direction. For example, the first mixture may be loaded at the bottom of a screw classifier conveyor positioned at an incline, while the second solvent may be introduced at the top of the screw classifier conveyor. An exemplary screw classifier conveyor suitable for use in this method is described in U.S. Pat. No. 2,666,242. As the screw classifier conveyor moves the first mixture upwardly, the second solvent may flow down the inclined screw classifier conveyor and pass through the first mixture. The second solvent may displace a second quantity of bitumen-enriched solvent phase contained in the first mixture, thereby "washing" the second quantity of bitumen-enriched solvent from the first mixture.

Separation of the second quantity of bitumen-enriched solvent phase and the first mixture may naturally occur based on the configuration of the screw classifier conveyor, with the predominantly liquid bitumen-enriched solvent phase collecting at one end of the washing unit and the predominantly solid first mixture collecting at the opposite end of the washing unit. For example, when an inclined screw classifier conveyor is used, the second quantity of bitumen-enriched solvent phase may collect at the bottom of the screw classifier conveyor, while the first mixture may collect at the top of the screw classifier conveyor.

The countercurrent process may include multiple stages. For example, after a first pass of second solvent through the first mixture, the resulting second quantity of bitumen-enriched solvent phase may be passed through the first mixture several more times. Alternatively, additional quantities of fresh second solvent may be passed through the first mixture one or more times. In this manner, the second quantity of bitumen-enriched solvent phase or fresh quantities of second solvent may become progressively more enriched with bitumen after each stage and the first mixture may lose progressively more bitumen after each stage.

When a plate and frame-type filter press is used to separate the second quantity of bitumen-enriched solvent phase from the first mixture through the addition of a second solvent, the process may generally include injecting the second solvent into the first mixture that is loaded in the frame chamber of the plate and frame-type filter press.

Any suitable type of plate and frame-type filter press may be used. The plate and frame-type filter press used for the separation of the second quantity of bitumen-enriched solvent phase may be a separate plate and frame-type filter press from the plate and frame-type filter press used to separate the first quantity of bitumen-enriched solvent phase from the first mixture, or may be the same plate and frame-type filter press used to separate the first quantity of bitumen-enriched solvent phase from the first mixture. When the same plate and frame-type filter press is used, the method may include adding the second solvent to the first mixture still loaded in the frame chamber after separation of the first quantity of bitumen-enriched solvent phase. In other words, the method need not include a step of removing the first mixture from the plate and frame-type filter press before injecting the second solvent.

The second solvent may be pumped into the plate and frame-type filter press where it may displace the second quantity of bitumen-enriched solvent phase from the first mixture located in the frame chambers. The second quantity of bitumen-enriched solvent phase displaced out of the first mixture may migrate through the filter clothes lining the frame chamber. Some of the second solvent injected into the first mixture may also migrate out of the frame chamber with the second quantity of bitumen-enriched solvent phase, but some of the second solvent may remain in the first mixture loaded in the frame chamber. In some embodiments, 95% or more of the bitumen-enriched solvent phase remaining in the first mixture may be displaced by the addition of the second solvent.

Gas may also be injected into the frame chamber prior to or following the injection of the second solvent into the first mixture. Injecting gas into the frame chamber may promote the separation of the bitumen-enriched solvent phase from mineral solids in the first mixture. By liberating the bitumen-enriched solvent phase in this manner, the bitumen-enriched solvent phase may be more likely to be displaced from the first mixture upon the addition of the second solvent. The process for adding gas may be identical to the method described above with respect to addition of gas as part of separating the first quantity of bitumen-enriched solvent phase from the first mixture in a plate and frame-type filter press.

When a vertical column is used to separate the second quantity of bitumen-enriched solvent, the process may generally include loading the first mixture in a vertical column and adding the second solvent to the first mixture from the top end of the vertical column. The second solvent may flow down through the vertical column, displacing the bitumen-enriched solvent phase from the first mixture loaded in the vertical column until a second quantity of bitumen-enriched solvent phase eventually exits the vertical column and the bottom end of the vertical column.

Any method of loading the first mixture in the vertical column may be used. First mixture may be poured into the vertical column or, when an appropriate first mixture viscosity is obtained, the first mixture may be pumped into the vertical column. The first mixture may be loaded in the vertical column by introducing the first mixture into the column at the top end of the vertical column. The bottom end of the vertical column may be blocked, such as by a removable plug or valve or by virtue of the bottom end of the vertical column resting against the floor. In some embodiments, a metal filter screen at the bottom end of the vertical column may be used to maintain the first mixture in the vertical column. As such, introducing the first mixture at the top end of the vertical column may fill the vertical column with first mixture. The amount of first mixture loaded in the vertical column may be such that the first mixture substantially fills the vertical column with first mixture. In some embodiments, first mixture may be added to the vertical column to occupy 90% or more of the volume of the vertical column. In some embodiments, the first mixture may not be filled to the top of the vertical column so that room is provided to inject the second quantity of the first solvent.

As noted above, the column may have a generally vertical orientation. The vertical orientation may include aligning the column substantially perpendicular to the ground, but also may include orientations where the column forms angles less than 90° with the ground. The column may generally be oriented at any angle that results in gravity aiding the flow of the second quantity of first solvent from one end of the column to the other. In some embodiments, the column may be oriented at an angle anywhere within the range of from about 10 to 90° with the ground. In a preferred embodiment, the column may be oriented at an angle anywhere within the range of from about 15° to 90° with the ground.

The material of the vertical column is also not limited. Any material that will hold the first mixture within the vertical column may be used. The material may also preferably be a non-porous material such that liquids injected into the vertical column may only exit the column from one of the ends of the vertical column. The material may be a corrosive resistant material so as to withstand the potentially corrosive components of the first mixture loaded in the column as well as any potentially corrosive materials injected into the vertical column.

The shape of the vertical column is not limited to a specific configuration. Generally speaking, the vertical column may have two ends opposite one another, designated a top end and a bottom end. The cross-section of the vertical column may be any shape, such as a circle, oval, square or the like. The cross-section of the vertical column may change along the height of the column, including both the shape and size of the vertical column cross-section. The vertical column may be a straight line vertical column having no bends or curves along the height of the vertical column. Alternatively, the vertical column may include one or more bends or curves.

Any dimensions may be used for the vertical column, including the height, inner cross sectional diameter and outer cross sectional diameter of the vertical column. In some embodiments, the ratio of height to inner cross sectional diameter may range from 0.5:1 to 15:1.

Once the first mixture is loaded in the vertical column, the second can be added into the vertical column. The second solvent may be added into the vertical column at the top end of the column such that the second solvent flows down and through the first mixture loaded in the column. The second solvent may be added into the vertical column by any suitable method. In some embodiments, the second solvent may be poured into the vertical column at the top end and allowed to flow down through the first mixture loaded therein under the influence of gravity. External forces may also be applied to the vertical column to assist the flow of the second solvent through the vertical column.

The amount of second solvent added to the first mixture loaded in the vertical column is not limited. The amount may preferably be enough second solvent to displace most or all of the remaining bitumen-enriched solvent in the first mixture. In some embodiments, the amount of second solvent added may be from about 1.25 to about 2.25 times the amount of bitumen by volume in the original material comprising bitumen.

Upon injection into the first mixture, the second solvent may flow downwardly through the height of the column via small void spaces in the first mixture. The second solvent may flow downwardly through the force of gravity or by an external force applied to the vertical column. Examples of external forces applied include the application of pressure from the top of the vertical column or the application of suction at the bottom of the vertical column. The second first solvent may typically travel the flow of least resistance through the first mixture. As the second solvent flows downwardly through the first mixture, bitumen-enriched solvent phase may be displaced out of the first mixture.

In some embodiments, the addition of second solvent may be carried out under flooded conditions. In other words, more second solvent may be added to the top of the vertical column than what flows down through the first mixture, thereby creating a head of solvent at the top of the vertical column and creating a "plug flow" condition through the column.

The bitumen-enriched solvent that is being displaced by the second solvent may flow downwardly through the height of the vertical column and exit the vertical column where it may be collected for further use and processing. In some embodiments, the bitumen-enriched solvent may include from about 10 wt % to about 60 wt % bitumen and from about 40 wt % to about 90 wt % second solvent. Minor amounts of non-bitumen material may also be included in the bitumen-enriched solvent phase. In some embodiments, 95% or more of the bitumen-enriched solvent phase may be removed from the first mixture through the addition of the second quantity of first solvent.

Any method of collecting the second quantity of bitumen-enriched solvent may be used, such as by providing a collection vessel at the bottom end of the vertical column. The bottom end of the vertical column may include a metal filter screen having a mesh size that does not permit first mixture to pass through but which does allow for the second quantity of bitumen-enriched solvent to pass through and collect in a collection vessel located under the screen. Collection of the second quantity of bitumen-enriched solvent may be carried out for any suitable period of time. In some embodiments, collection is carried out for 2 to 30 minutes.

The method may include further additions of second solvent to displace any remaining bitumen-enriched solvent phase from the first mixture loaded in the vertical column. In other words, after injecting a first quantity of second solvent and collecting the bitumen-enriched solvent at the bottom of the vertical column, a second quantity of second solvent may be added to the vertical column to displace additional bitumen-enriched solvent from the first mixture. Repeating these steps may increase the overall removal rate of bitumen-enriched solvent phase from the first mixture. In some embodiments, the use of multiple second solvent injection steps may result in the removal of 95% or more of the bitumen-enriched solvent phase in the first mixture.

The second quantity of bitumen-enriched solvent phase collected according to any of the above-described methods may be combined with the first quantity of bitumen-enriched solvent phase prior to any further processing conducted on the bitumen-enriched solvent phase. The combined bitumen-enriched solvent phase may undergo further processing to, for example, isolate the bitumen from the solvent and/or upgrade the bitumen. Isolation of the bitumen content may be carried out according to any method know to those of ordinary skill in the art, including heating the bitumen-enriched solvent phase to a temperature above the boiling point temperature of the first solvent in order to evaporate the first solvent. Any evaporated solvent may be captured and condensed for further use. Upgrading of the bitumen may comprise any processing that generally produces a stable liquid (i.e., synthetic crude oil) and any subsequent refinement of synthetic crude oil into petroleum products. The process of upgrading bitumen to synthetic crude oil may include any processes known to those of ordinary skill in the art, such as heating or cracking the bitumen to produce synthetic crude. The process of refining synthetic crude may also include any processes known to those of ordinary skill in the art, such as distillation, hydrocracking, hydrotreating and coking. They petroleum products produced by the upgrading are not limited, any may include petroleum, diesel fuel, asphalt base, heating oil, kerosene, and liquefied petroleum gas.

Optionally, the method may include further steps to remove any second solvent remaining in the first mixture after the second quantity of bitumen-enriched solvent phase has been displaced. In some embodiments, the removal of the second solvent may only take place after most or all of the bitumen in the first mixture has been removed from the first mixture (e.g., by removing most or all the bitumen-enriched solvent phase from the first mixture).

In embodiments where the second solvent is a light aromatic solvent, the second solvent may be removed by displacing the second solvent from the first mixture through the addition of a third solvent to the first mixture. The third solvent can be any suitable solvent that is useful for displacing the second solvent from the first mixture. In some embodiments, the third solvent may have a lower vapor pressure than the second solvent to enhance removal of the third solvent in subsequent processing steps. In some embodiments, the third solvent may be a hydrocarbon solvent. Any suitable hydrocarbon solvent or mixture of hydrocarbon solvents that is capable of displacing the first solvent may be used. The hydrocarbon solvent or mixture of hydrocarbon solvents can be economical and relatively easy to handle and store. The hydrocarbon solvent or mixture of hydrocarbon solvents may also be generally compatible with refinery operations.

In some embodiments, the third hydrocarbon solvent can include one or more volatile hydrocarbon solvents. The volatile hydrocarbon solvent may be identical to the volatile hydrocarbon solvent described above in greater detail.

Adding third solvent to the first mixture may be carried out in any suitable manner that results in second solvent displacement from the first mixture. In some embodiments, third solvent may be added to the first mixture in an identical manner to any of the methods described above for the addition of the second solvent to the mixture. For example, the third solvent may be added to a first mixture loaded in a plate and frame-type filter press, the third solvent may be added to the first mixture in a countercurrent washing process, or the third solvent may be added to the first mixture loaded in a vertical column.

The amount of the third solvent added to the first mixture may be sufficient to effectively displace at least a portion, or desirably all, of the second solvent remaining in the first mixture after separation of the second quantity of bitumen-enriched solvent phase. The amount of third solvent added to the first mixture may be approximately 0.5 to 1 times the amount of bitumen by volume originally contained in the material comprising bitumen.

As with previously described separation steps, separation of the second solvent from the first mixture may be preceded or followed by applying pressurized gas over the first mixture. Applying a pressurized gas over the first mixture may facilitate the separation of the second solvent from the non-bitumen components of the first mixture. The liberated second solvent can then be removed from the first mixture upon the addition of the third solvent to the first mixture. Any suitable gas may be used. In some embodiments, the gas may be an inert gas. In some embodiments, the gas may be nitrogen, carbon dioxide or steam. The gas may also be added over the first mixture in any suitable amount. In some embodiments, 1.8 $m^3$ to 10.6 $m^3$ of gas per ton of material comprising bitumen may be used. This is equivalent to a range of about 4.5 liters to 27 liters of gas per liter of material comprising bitumen. In some embodiments, 3.5 $m^3$ of gas per ton of material comprising bitumen may be used.

In some embodiments, the addition of third solvent to the first mixture may result in the removal of 95% or more of the second solvent in the first mixture. The second solvent may leave the first mixture as a mixture of second solvent and third solvent. The second solvent-third solvent mixture may include from about 5 wt % to about 50 wt % second solvent and from about 50 wt % to about 95 wt % third solvent.

The removal of the second solvent from the first mixture through the addition of third solvent may result in a quantity of third solvent not passing all the way through the first mixture. In some embodiments, the first mixture may include from about 70 wt % to about 95 wt % non-bitumen components and from about 5 wt % to about 30 wt % third solvent after removal of the first solvent from the first mixture. As such, the first mixture may undergo further processing to remove the third solvent produce solvent-dry tailings.

Any manner of removing third solvent from the first mixture may be used. In some embodiments the third solvent may be removed from the first mixture by drying, flashing or heating the first mixture. In this manner, the third solvent may evaporate from the first mixture and leave behind solvent-dry tailings. Separation of the third solvent from the first mixture may result in 95% or more of the third solvent in the first mixture being removed.

When the third solvent is a volatile hydrocarbon, the energy required to remove the third solvent may be minimal. In some embodiments, the third solvent may be removed from the solvent-wet tailings at room temperature.

Removal of the third solvent from the first mixture may also result in the separation of any second solvent still present in the first mixture. Separation of the second solvent may occur together with the separation of the third solvent, such as by heating or flashing the solvent wet tailings in a manner causing both solvents to evaporate from the first mixture. Alternatively, the separation may be incremental, wherein the flashing or heating is carried out to start with at conditions that will cause only the third solvent to evaporate, followed by adjusting the conditions to cause the evaporation of the second solvents. Any solvent removed from the first mixture may be recovered for further use, such as by sending the evaporated solvents to stills.

The solvent-dry tailings resulting from removal of the third solvent from the first mixture may generally include inorganic solids, such as sand and clay, water, and little to no second and third solvent. As used herein, the term "solvent-dry" means containing less than 0.1 wt % total solvent. The water content of the solvent-dry tailings may range from about 2 wt % to about 15 wt %. This range of water content may create a damp tailings that will not produce dust when transporting or depositing the tailings. This range of water content may also provide a stackable tailings that will not flow like dry sand, and therefore has the ability to be retained within an area without the need for retaining structures (e.g., a tailings pond). This range of water content may also provide tailings that are not so wet as to be sludge-like or liquid-like.

In embodiments where the second solvent is a volatile hydrocarbon solvent, the second solvent may be removed by drying, flashing or heating the first mixture. Removal of the second solvent may be accomplished by any of the procedure with minimal energy input due to the volatility of the second solvent. The second solvent may evaporate from the first mixture and leave behind solvent-dry tailings as described above. Separation of the second solvent from the first mixture may result in 95% or more of the second solvent in the first mixture being removed.

Figure 3:
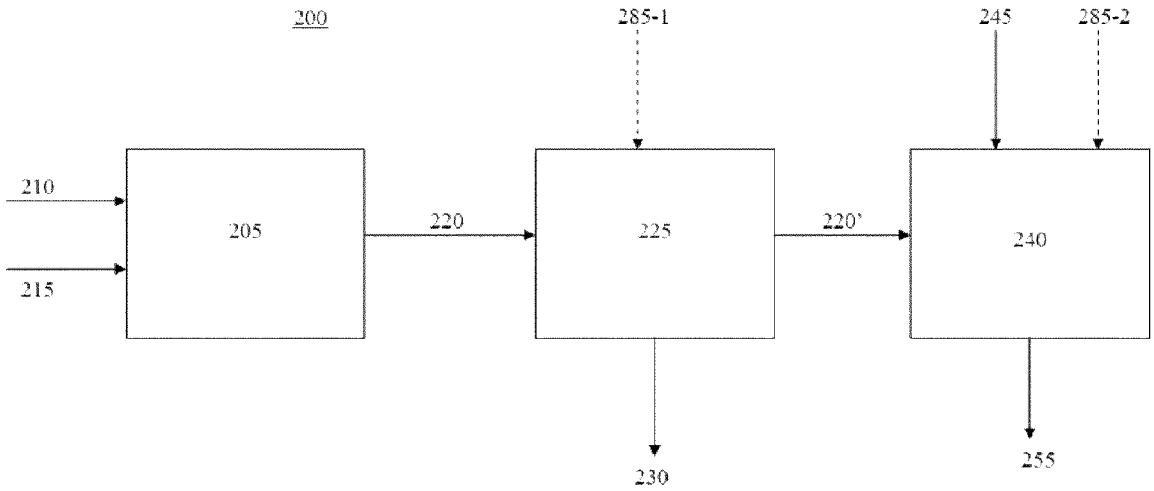
FIG. 3 is a schematic diagram for a system and method for obtaining bitumen from bituminous material as disclosed herein.

With reference to FIG. 3, a system 200 for carrying out the above-described method may include a mixer 205 for mixing material comprising bitumen 210 and a first solvent 215. Any suitable mixing vessel may be used, including a mixing vessel that operates under pressure in order to maintain the first solvent as a liquid. A first mixture 220 is formed by the mixing of the material comprising bitumen 210 and the first solvent 215 in the mixer 205. The first mixture 220 contains bitumen-enriched solvent phase.

The first mixture 220 is transported to a first separation unit 225 where a first quantity of bitumen-enriched solvent phase 230 is separated from the first mixture 220. Any filtration, or settling separation unit suitable for separating the first quantity of bitumen-enriched solvent phase 230 from the first mixture 220 may be used. Gas 285-1 may be pumped into the first separation unit 225 to promote separation of bitumen-enriched solvent phase from the non-bitumen components of the material comprising bitumen. When gas 285-1 is pumped into first separation unit 225, the spent gas may also exit the first separation unit 225 with the first quantity of bitumen-enriched solvent phase 230. Because the gas does not dissolve in either the bitumen or the first solvent of the first mixture 220, the gas exits with the first quantity of bitumen-enriched solvent phase 230 and does not require any additional separation processing.

The first mixture 220' remaining after the separation of the first quantity of bitumen-enriched solvent phase 230 is transported to a second separation unit 240 where a second solvent 245 is added to the first mixture 220' in order to separate a second quantity of bitumen-enriched solvent phase 255 from the first mixture 220'. Any separation unit suitable for separating the second quantity of bitumen enriched solvent 255 from the first mixture 220' through the addition of a second solvent 245 may be used. Gas 285-2 may be pumped into the second separation unit 240 to promote separation of the bitumen-enriched solvent phase from the non-bitumen components of the first mixture 220'. In some embodiments, separation units 225 and 240 may be one in the same unit to avoid the need to transport first mixture 220'.

Figure 4:
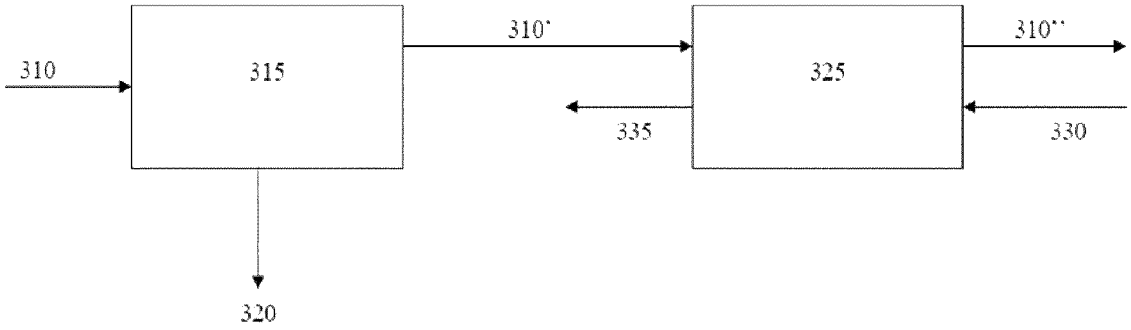
FIG. 4 is a schematic diagram for a system and method for obtaining bitumen from bituminous material as disclosed herein.

With reference to FIG. 4, a version of the system used to carry out the method of the above embodiment wherein countercurrent washing is shown. Pre-mixture 310 includes material comprising bitumen mixed with first solvent to cause bitumen to dissolve in the first solvent. The pre-mixture 310 is transported to a first separation unit 315 where a first quantity of bitumen-enriched solvent phase 320 is separated from the pre-mixture 310. The first separation unit 315 may be any type of filtering, settling or drainage separation unit suitable for separating a first quantity of bitumen-enriched solvent phase 320 from the pre-mixture 310.

The pre-mixture 310' remaining after the separation of the first quantity of bitumen-enriched solvent phase 320 is transported to a washing unit 325. The pre-mixture 310' moves in a first direction and a second solvent 330 moves in an opposite direction towards the pre-mixture 310'. The pre-mixture 310' mixes with the second solvent 330, during which a second quantity of bitumen-enriched solvent phase 335 is displaced from the pre-mixture 310' by the second solvent 330. The second quantity of bitumen-enriched solvent phase 335 and the first mixture 310" separate due to the countercurrent configuration of the washing unit 325. In some embodiments, a portion of the bitumen enriched solvent phase 335 may be mixed with material comprising bitumen to form pre-mixture 310.

Figure 5:
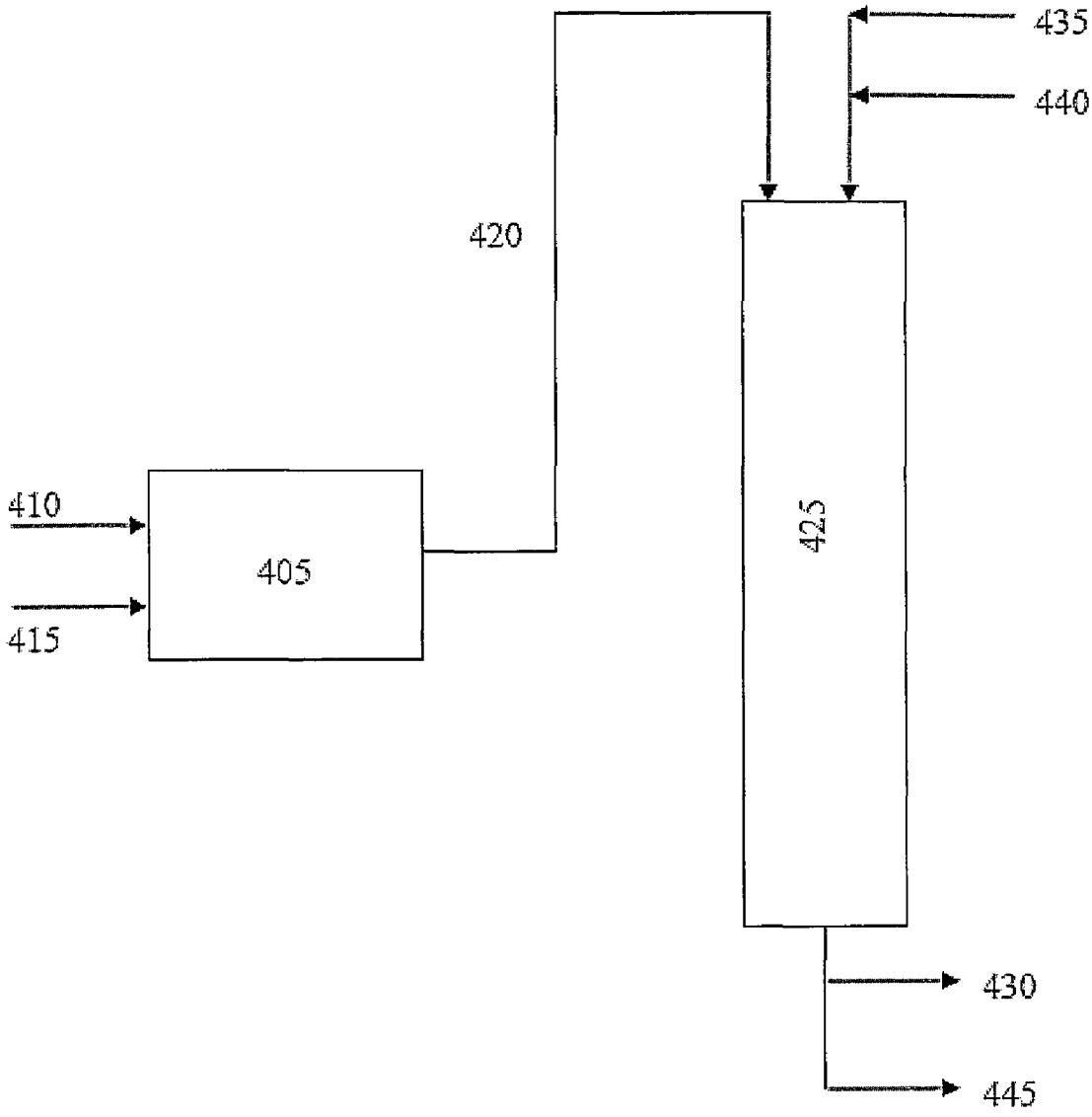
FIG. 5 is a schematic diagram for a system and method for obtaining bitumen from bituminous material as disclosed herein.

With reference to FIG. 5, another version of the system used to carry out the method of this embodiment where a vertical column is utilized is shown. A mixing vessel 405 is provided for mixing material comprising bitumen 410 with a first solvent 415 to form a first mixture 420. Any type of mixing vessel may be used to mix the material comprising bitumen 410 and the first solvent 415.

The first mixture 420 is then loaded in the vertical column 425. FIG. 4 depicts the first mixture 420 being loaded in the top end of the vertical column 425, but the first mixture 420 can also be loaded from the bottom end of the vertical column 425 or from the side of the vertical column 425. Once the first mixture 420 is loaded in the vertical column 425, a first quantity of bitumen-enriched solvent phase 430 is filtered out of the vertical column. Filtering of the first quantity of bitumen-enriched solvent phase 430 can be under the force of gravity or with the aid of a gas 435. The first quantity of bitumen-enriched solvent phase 430 is collected at the bottom end of the vertical column 425. Any gas 435 injected into the first mixture 420 may also exit out of the vertical column.

A second solvent 440 is injected into the top end of the vertical column 425. The second solvent 440 flows down the height of the vertical column 425, displacing a second quantity of bitumen-enriched solvent phase 445 from the first mixture 420. The non-bitumen components of the material comprising bitumen remain in a packed condition in the vertical column 425 as the second solvent 440 passes through the first mixture 425 and displaces the second quantity of bitumen-enriched solvent phase 445. The second quantity of bitumen-enriched solvent phase 445 exits the bottom end of the vertical column 425 along with any of the second solvent 440 that travels all the way through the vertical column 425.

As described in greater detail in co-pending U.S. application Ser. Nos. 12/041,554 and 11/249,234, further processing may be performed on the components produced by the methods described above. For example, the first quantity and second quantity of bitumen-enriched solvent phase may be processed to separate the bitumen therefrom. Furthermore, as described in co-pending application Ser. No. 12/509,298, herein incorporated by reference, any bitumen obtained from the above-described methods or from further processing of the bitumen-enriched solvent phases produced by the above-described processes may be cracked in a nozzle reactor (with or without deasphalting) to produce light hydrocarbon distillate. The light hydrocarbon distillate may then be used as a first solvent to extract bitumen from material comprising bitumen. In one example, the light hydrocarbon distillate produced may be recycled within the same process to initiate extraction of bitumen from further material comprising bitumen. Additionally, any solvent separated or removed from a mixture may be recovered and reused in the process. For example, where the bitumen-enriched solvent phases are separated into bitumen and first solvent, the first solvent may be recovered and reused in the process. Separation of the solvents may be accomplished by any know method, such as through the use of stills.

EXAMPLES

Example 1

Semi-Continuous Countercurrent Washing Using a Plate and Frame Horizontal Filter Press A first bitumen extraction experiment was conducted using a plate and frame filter press. 600 kg of oil sand ore having a bitumen content of 6 wt % (i.e., 36 kg bitumen content) was mixed with a primary solvent of Solvesso 150. The primary solvent to bitumen volume ratio was about 2:1. The primary solvent and oil sand ore was mixed for 15 minutes in a disaggregation device.

The ore/solvent mixture was removed from the disaggregation device and pumped to the plate and frame filter press. The plate and frame filter press was filled through a fill orifice until pressure reached a maximum. The plate and frame filter was pressurized with an inert gas and the bitumen-enriched solvent phase collected at the outlet of the plate and frame filter press. The bitumen-enriched solvent phase weighed 70 kg, including 22 kg of bitumen and 48 kg of primary solvent. First mixture remained in the filter press.

A secondary solvent of methanol was pumped into the plate and frame filter press at a solvent to original bitumen weight volume ratio of 1.5:1. The plate and frame filter press was pressurized with inert atmosphere and the secondary solvent was forced through the first mixture in a plug flow 'washing' action. The secondary bitumen-enriched solvent phase was collected at the outlet of the plate and frame filter press. The secondary bitumen-enriched solvent phase weighed 74 kg, including 7 kg of bitumen and a combined 67 kg of primary and secondary solvent.

As 22 kg of bitumen was collected in the primary bitumen-enriched solvent phase and 7 kg of bitumen was collected in the secondary bitumen-enriched solvent phase, a total of 29 kg of bitumen was extracted from 600 kg of oil sand ore having 36 kg of bitumen contained therein. Accordingly, 81% of the bitumen in the sample was extracted from the low grade oil sand.

Example 2

Semi-Continuous Countercurrent Washing Using a Vertical Column

A second bitumen extraction experiment was conducted using a vertical column. 600 kg of oil sand ore having a bitumen content of 6 wt % (i.e., 36 kg bitumen content) was mixed with a primary solvent of Solvesso 150. The primary solvent to bitumen volume ratio was about 2:1. The primary solvent and oil sand ore was mixed for 15 minutes in a disaggregation device.

The ore/solvent mixture was removed from the disaggregation device and pumped to the top end of the vertical column. The vertical column was filled with the ore/solvent mixture until a bed of full height was formed, and the top end of the vertical column was then sealed. The vertical column had a height of 6 feet and an inner diameter of 22 inches. Filtering with the aid of overpressure was then performed to separate a primary bitumen-enriched solvent phase. The vertical column was pressurized with an inert gas and the primary bitumen-enriched solvent phase was collected at the bottom end of the vertical column. The primary bitumen-enriched solvent phase weighed 72 kg, including 24 kg of bitumen and 48 kg of primary solvent. First mixture remained in the vertical column.

A secondary solvent of methanol was pumped into the top end of the vertical column at a solvent to original bitumen volume ratio of 2:1. The vertical column was pressurized with inert atmosphere and the secondary solvent was forced through the first mixture in a plug flow 'washing' action. The secondary bitumen-enriched solvent phase was collected at the bottom end of the vertical column. The secondary bitumen-enriched solvent phase weighed 92 kg, including 8 kg of bitumen and a combined 84 kg of primary and secondary solvent.

As 24 kg of bitumen was collected in the primary bitumen-enriched solvent phase and 8 kg of bitumen was collected in the secondary bitumen-enriched solvent phase, a total of 32 kg of bitumen was extracted from 600 kg of oil sand ore having 36 kg of bitumen contained therein. Accordingly, 89% of the bitumen in the sample was extracted from the low grade oil sand.

Example 3

Laboratory Scale Testing of Low Grade Ore Using Light Aromatic Primary Solvent and Aliphatic Secondary Solvent One kilogram of low grade oil sand ore, containing about 9% bitumen, was mixed with 400 grams of naphtha (light aromatic primary solvent) in a beaker equipped with an agitator with a bow-tie blade. The mixture of low grade oil sand ore and naphtha was agitated about one hour. The resulting slurry was transferred into a Buchner filter lined with a coarse filter paper. Vacuum was applied for about 15 minutes until the cake appeared to be "dry". The cake removed from the Buchner filter had an API gravity of about 27. The cake was then placed into a 2 liter nutsche with a pressure rating of 20 bar. A 3 bar pressure nitrogen purge was applied to expel a quantity of bitumen-enriched naphtha. Subsequently, about one liter of liquid propane (aliphatic secondary solvent) at 15 bar pressure was added to the nutsche. After the liquid propane at 15 bar pressure was added to the nutsche, the pressure let down valve was opened and the nutsche free board over pressure discharged all of the entrained bitumen-enriched solvent displaced from the cake by the liquid propane. To prevent freezing at the discharge valve, the discharge valve was placed in a temperature controlled hot water bath. Any excess propane that flashed off was burned and vented to the atmosphere. This displacement procedure generally lasted about 15 minutes. After all the propane was removed, another nitrogen purge was performed. A clean and somewhat compacted filter cake was then discharged. The filter cake was analyzed for residual bitumen and assayed 1.23% bitumen. Based on the bitumen content of the original low grade oil sand ore, a bitumen recovery of about 88% was calculated.

Example 4

Example 3 for Various Grades of Oil Sands

Figure 1:
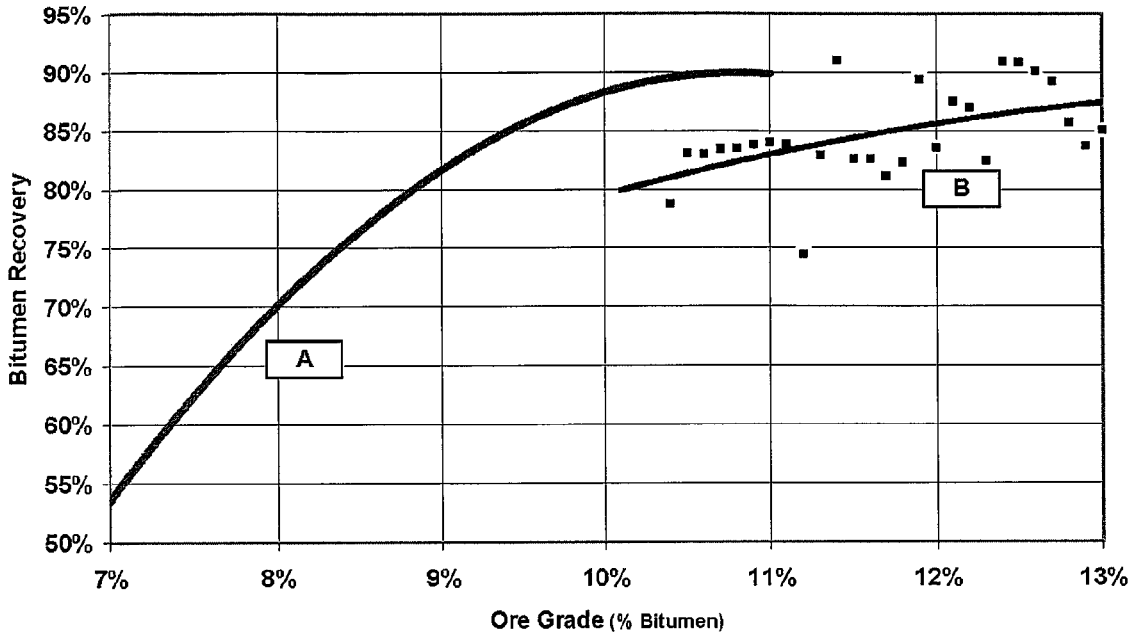
FIG. 1 is a graph showing the minimum bitumen extraction rate as stipulated by the Alberta Energy and Utilities Board for hot water extraction methods using naphtha-based froth treatment of various grades of ore sands and the actual bitumen extraction rates achieved using a hot water extraction method using paraffinic froth treatment for various grades of ore sands.
Figure 6:
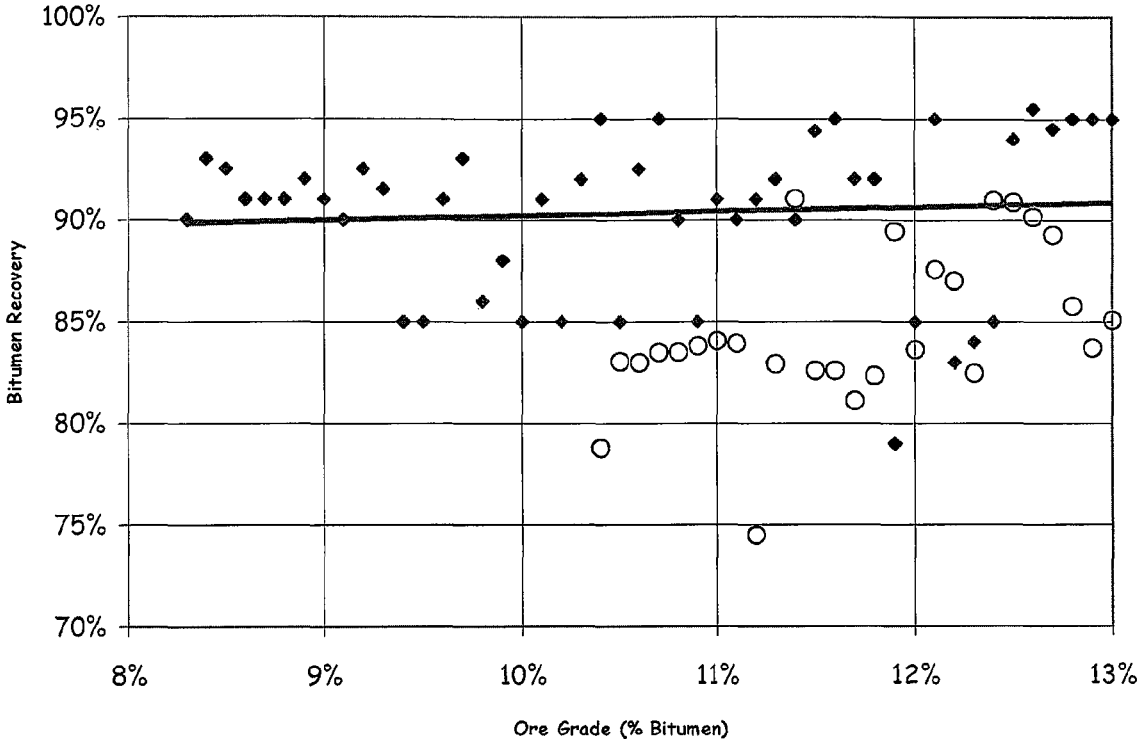
FIG. 6 is the graph shown in FIG. 1 and further including the bitumen extraction rates achieved for oils sands of various grades using the method described herein.

The bitumen extraction process as described above in Example 3 was performed on oil sand ores of various grades ranging from about 8% to about 13%. The diamond shaped data points in FIG. 6 show the bitumen recovery rates for the various grades of oil sands when utilizing the process described in Example 3, while the circle shaped data points show the extraction rates achieved by a conventional hot water process combined with paraffinic froth treatment. FIG. 6 also includes a least square fit line for all of the diamond-shaped data points. When comparing the data in FIG. 6 with line A in FIG. 1, it can be seen that the method described in Example 3 achieves extraction rates above the rates stipulated by the Alberta Energy and Utilities Board as well as above the results achieved by the convention hot water extraction process.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A method comprising:

mixing a material comprising bitumen with a first solvent and forming a first mixture, wherein the first mixture comprises a bitumen-enriched solvent phase;

filtering or settling the first mixture and separating a first portion of the bitumen-enriched solvent phase from the first mixture; and adding a second solvent to the first mixture and separating a second portion of the bitumen-enriched solvent phase from the first mixture;

wherein the first solvent is a different type of solvent from the second solvent.

2. The method as recited in claim 1, wherein the material comprising bitumen comprises less than 10 wt % bitumen.

3. The method as recited in claim 1, wherein the first portion of the bitumen-enriched solvent phase and the second portion of the bitumen-enriched solvent phase account for 90% or more of the bitumen-enriched solvent phase included in the first mixture.

4. The method as recited in claim 1, wherein adding the second solvent to the first mixture comprises washing the first mixture with the second solvent in a countercurrent fashion.

5. The method as recited in claim 1, further comprising loading the first mixture in a vertical column having a top end and a bottom end prior to separating the second portion of the bitumen-enriched solvent phase from the first mixture by adding a second solvent to the first mixture.

6. The method as recited in claim 5, wherein adding the second solvent to the first mixture comprises adding the second solvent to the first mixture at the top end of the vertical column.

7. The method as recited in claim 5, wherein the second quantity of bitumen-enriched solvent phase is collected at the bottom end of the vertical column.

8. The method as recited in claim 5, further comprising adding gas over the first mixture loaded in the vertical column.

9. The method as recited in claim 1, further comprising loading the first mixture into a plate and frame-type filter press prior to adding the second solvent to the first mixture.

10. The method as recited in claim 9, wherein adding the second solvent to the first mixture comprises introducing the second solvent into the first mixture loaded in the plate and frame-type filter press.

11. The method as recited in claim 9, further comprising adding gas over the first mixture loaded in the plate and frame-type filter press.

12. The method as recited in claim 1, wherein the first solvent comprises a light aromatic solvent.

13. The method as recited in claim 12, wherein the second solvent comprises a volatile hydrocarbon solvent.

14. The method as recited in claim 12, wherein the second solvent comprises a polar solvent.

15. The method as recited in claim 14, wherein the polar solvent comprises an oxygenated hydrocarbon compound.

16. The method as recited in claim 12, wherein the light aromatic solvent comprises kerosene, diesel, gas oil, naphtha, benzene, toluene, an aromatic alcohol, derivatives thereof, or a combination thereof.

17. The method as recited in claim 1, wherein the material comprising bitumen comprises tar sands.

18. The method as recited in claim 1, wherein mixing the material comprising bitumen with the first solvent comprises mixing the material comprising bitumen and the first solvent for a period of from 5 seconds to 60 minutes.

19. The method as recited in claim 1, wherein mixing the material comprising bitumen with the first solvent comprises low intensity blending.

20. The method as recited in claim 1, wherein the amount of first solvent mixed with the material comprising bitumen is from 0.5 to 6.0 times the amount of bitumen by volume in the material comprising bitumen.

21. The method as recited in claim 1, wherein the amount of second solvent added to the first mixture is from 10% to 400% of the amount of first solvent mixed with the material comprising bitumen.

22. The method as recited in claim 1, further comprising:

upgrading a bitumen component of the first portion of the bitumen-enriched solvent phase or the second portion of the bitumen-enriched solvent phase.

23. A method comprising:

mixing a material comprising bitumen with a first solvent;

filtering or settling a first portion of bitumen-enriched solvent phase from a first result of mixing the material comprising bitumen with the first solvent; and adding a second solvent to a second result of filtering or settling the first portion of bitumen-enriched solvent phase from the first result;

wherein the first solvent is a different type of solvent from the second solvent.

24. The method as recited in claim 23, wherein the material comprising bitumen comprises less than 10 wt % bitumen.

25. The method as recited in claim 23, wherein the first solvent comprises a light aromatic solvent.

26. The method as recited in claim 25, wherein the second solvent comprises a volatile hydrocarbon solvent.

27. The method as recited in claim 25, wherein the second solvent comprises a polar solvent.

28. The method as recited in claim 23, wherein the material comprising bitumen comprises tar sands.

29. The method as recited in claim 23, further comprising:

upgrading a bitumen component of the first portion of the bitumen-enriched solvent phase or a bitumen component of a third result of adding a second quantity of first solvent to the second result.

30. A method comprising:

mixing a material comprising bitumen with a first solvent and forming a first mixture, wherein the first mixture comprises a bitumen-enriched solvent phase;

separating a first portion of the bitumen-enriched solvent phase from the first mixture and forming a bitumen-depleted tailings phase; and adding a second solvent to the bitumen-depleted tailings phase and separating a second portion of the bitumen-enriched solvent phase from the bitumen-depleted tailings phase;

wherein the boiling point temperature of the first solvent is from about 75° C. to about 350° C. and the boiling point temperature of the second solvent is from about −20° C. to 150° C.

* * * * *